United States Patent [19]

Bertolazzi

[11] 4,377,128

[45] Mar. 22, 1983

[54] APPARATUS FOR INSIDE COATING DOUBLE CURVED SHELL

[75] Inventor: Luciano F. Bertolazzi, Wheaton, Ill.

[73] Assignee: Chicago Bridge & Iron Company, Plainfield, Ill.

[21] Appl. No.: 345,040

[22] Filed: Feb. 2, 1982

[51] Int. Cl.[3] ..... B05B 13/06

[52] U.S. Cl. ..... 118/317; 118/506

[58] Field of Search ..... 118/317, 506

[56] References Cited

U.S. PATENT DOCUMENTS 4,333,973 6/1982 Bellafiore et al. ..... 427/424

*Primary Examiner*—James R. Hoffman

*Attorney, Agent, or Firm*—Merriam, Marshall & Bicknell

[57] ABSTRACT

Apparatus for applying a coating to the inside surface of a spherical or spheroidal shell comprising a work platform for coating equipment; a first extendable and retractable leg in compression joined at its upper end to the platform and joined at its lower end through a horizontal axis pivot to a collar rotatable about a vertical axis on a lower fixed base; and a second extendable and retractable leg in tension joined at its lower end to the platform and joined at its upper end through a horizontal axis pivot to a collar rotatable about a vertical axis on an upper fixed base spaced upwardly from the lower fixed base whereby the lower end of the first leg and the upper end of the second leg can rotate about the same vertical axis.

A method of coating the inside surface of a spherical or spheroidal shell using the apparatus is also disclosed. By use of the apparatus horizontal bands of a coating are applied to the shell surface. The coating can be an insulating foam.

10 Claims, 5 Drawing Figures

FIG. 1
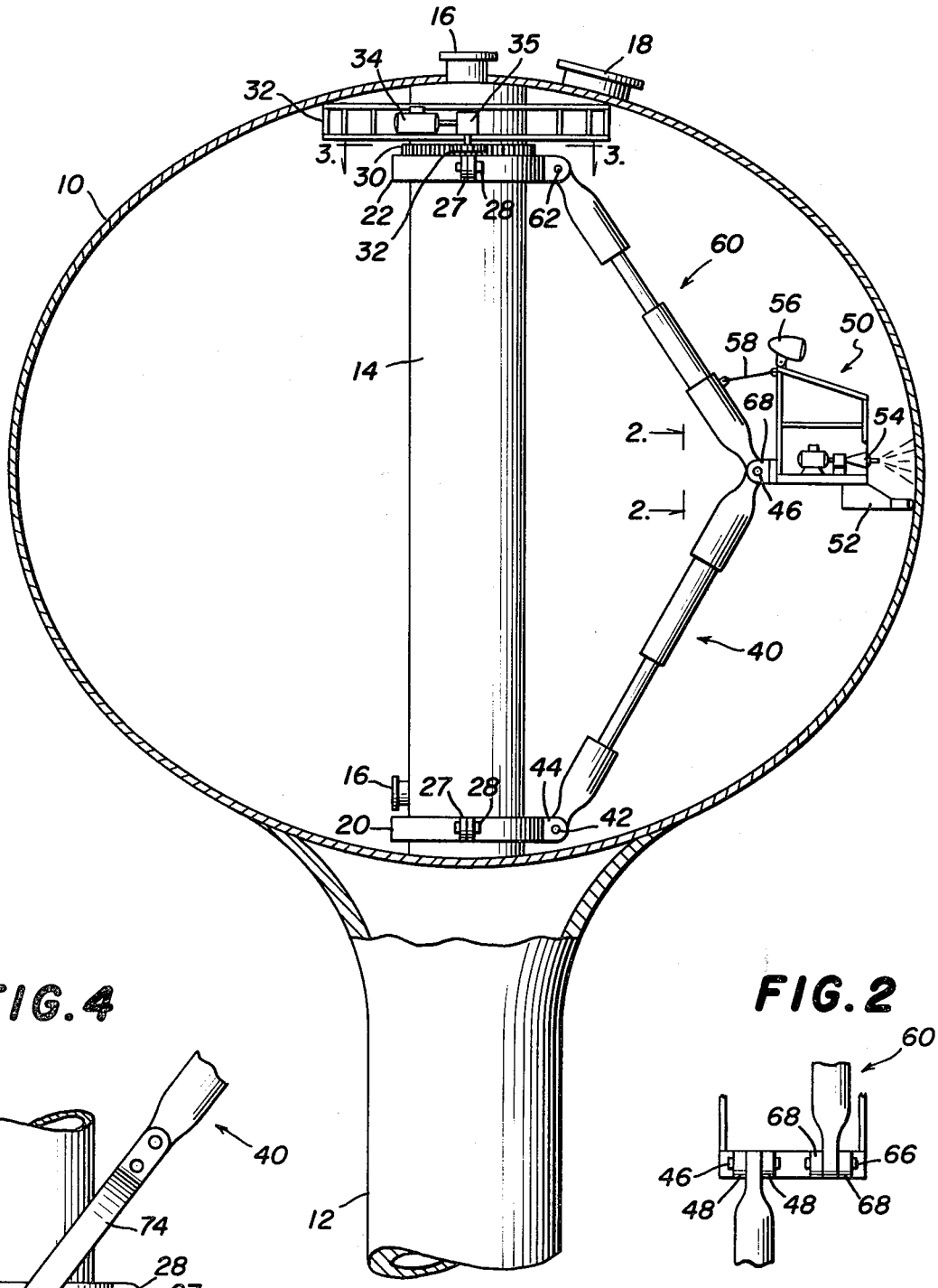
FIG. 4
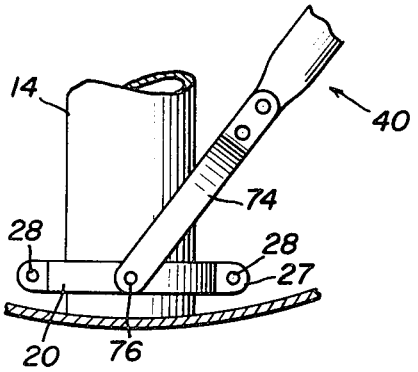
FIG. 2

APPARATUS FOR INSIDE COATING DOUBLE CURVED SHELL

This invention relates to apparatus for, and methods of, coating objects and structures. More particularly, this invention pertains to novel apparatus for, and methods of, coating the interior surfaces of double curved shells, such as those having spherical or spheroidal shapes.

BACKGROUND OF THE INVENTION

Double curved shells, usually of metal, are widely used to store fluids such as water, liquefied gases and liquid petroleum products. The double curved shells are generally spherical or spheroidal in shape. At times it is necessary to place a coating on the shell interior surface. The coating can be a paint, polymeric film or an insulating layer such as one made of a polymeric material foamed-in-place, especially polyurethane foam.

Because of the large size of many of the shells it is difficult to properly coat their interior surface because of a lack of support for workmen and essential coating equipment. Present methods employ substantial scaffolding, walk ways and ladders, none of which is easily supported or assembled in the shell because of its shape.

Garis et al U.S. Pat. No. 3,548,453 and Larsen U.S. Pat. No. 3,991,842 disclose apparatus for insulating the exterior vertical walls of cylindrical tanks but they do not disclose a method or apparatus for coating the surface of a double curved shell, either on the interior or exterior surface.

Bellafiore et al pending U.S. patent application Ser. No. 176,185 filed Aug. 7, 1980, now U.S. Pat. No. 4,333,973, discloses a vehicle-like machine for applying foamed-in-place insulation on substantially flat or sloped surfaces using a reciprocating member which applies the foam in adjacent parallel strips or bands in overlapping or side-by-side arrangement.

The Dow Chemical Company apparently produces spheres and hemispheres of rigid plastic foam by a method identified as spiral generation. The method uses a specially designed machine which bends, places and bonds pieces of plastic foam together into a predetermined shape. The machine head is mounted on a boom which swings around a pivot, laying and bonding layer upon layer of foam board in a rising spherical form. The Dow machine use is believed limited, however, to producing walls for truly spherical structures or spherical sections and is apparently not used to coat the shell. Also, since the boom length is apparently constant it would be unsuitable both for forming nonspherical sections which do not have circular sections through the vertical axis and for coating the interior surface. This is because the working head of the boom could not be maintained a uniform distance from a nonspherical shell wall with a constant length boom.

From the above discussion it is believed clear that a need exists for novel apparatus and methods which can be used to coat double curved interior surfaces of shells, such as spherical and spheroidal shells.

SUMMARY OF THE INVENTION

According to one aspect of the invention, there is provided apparatus for applying a coating to the inside surface of a double-curved shell, comprising a work platform for coating equipment; a first extendable and retractable leg in compression joined at its upper end to the platform and joined at its lower end through a horizontal axis pivot to first means rotatable about a vertical axis on a lower fixed base; and a second extendable and retractable leg in tension joined at its lower end to the platform and joined at its upper end through a horizontal axis pivot to means rotatable about a vertical axis on an upper fixed base spaced upwardly from the lower fixed base whereby the lower end of the first leg and the upper end of the second leg can rotate about a common vertical axis.

The first means rotatable about a vertical axis can be a bearing mounted collar and the second means rotatable about a vertical axis can be a bearing mounted collar.

To facilitate use of the apparatus, the lower fixed base and the upper fixed base are each desirably mounted on or are a part of a vertical column.

When a spherical or spheroidal shell is to be coated, the lower fixed base is generally located inside and near the bottom of the spherical or spheroidal shell while the upper fixed base is generally located inside and near the top of the said shell.

Although the first leg can be mechanically extendable it is more suitable for the first leg to be made hydraulically extendable. This also applies to the second leg.

The apparatus also desirably includes means to maintain the platform approximately horizontal when it is displaced vertically and horizontally.

Because the apparatus will inherently have substantial weight because of its intended use on large structures, power driven means to rotate the apparatus about the vertical axis is also advisably incorporated in it.

As a practical matter, in most cases where the apparatus will probably be used the legs dictate that the platform be vertically displaceable, by extending and retracting the first and second legs, for a distance less than the distance between the lower and upper fixed bases.

Furthermore, the platform will almost always be horizontally displaceable simultaneously with its vertical displacement.

According to a second aspect of the invention, there is provided a method of applying a coating to the inside surface of a double-curved shell which is circular in horizontal section, comprising positioning apparatus in the shell having a work platform for coating equipment; a first extendable and retractable leg in compression joined at its upper end to the platform and joined at its lower end through a horizontal axis pivot to first means rotatable about a vertical axis, through the center of the shell, on a lower fixed base; and a second extendable and retractable leg in tension joined at its lower end to the platform and joined at its upper end through a horizontal axis pivot to means rotatable about a vertical axis, through the center of the shell, on an upper fixed base spaced upwardly from the lower fixed base whereby the lower end of the first leg and the upper end of the second leg can rotate about the same vertical axis; extending or retracting the first and second legs to position the work platform adjacent the shell surface; rotating the apparatus about its vertical axis while applying a coating from the work platform to the shell surface as a horizontal band extending circumferentially around the shell surface; extending or retracting the first and second legs to position the work platform adjacent an area of the shell surface which has not been coated; rotating the apparatus about its vertical axis while applying a coating from the work platform to the shell surface as a second horizontal band extending circumferentially around the shell surface; and repeating the described application of coating bands until a substantial portion of the shell surface is coated.

In most instances, successive coating bands will be placed adjoining previously applied coating bands.

Application of the bands is desirably continued until only dished circular areas at the top and bottom of the shell remain uncoated. The dished circular areas can then be coated without use of the apparatus, such as by manual spraying.

Each band of the coating can be applied by spraying the coating on in vertical passes, in side-by-side arrangement and/or with partial overlapping of passes.

The coating can be a paint, polymeric coating or an insulating material. The method is particularly useful for applying a foamed-in-place polymeric material as an insulating material.

BRIEF DESCRIPTION OF THE DRAWINGS

FIG. 1 is an elevational view, partially in section, of a spheroidal shell mounted on a pedestal such as in an elevated water storage tank;

FIG. 2 is a vertical view taken along the line 2—2 of FIG. 1;

FIG. 4 is an elevational view of an alternative structure useful for connecting the legs to a pivot means.

DETAILED DESCRIPTION OF THE DRAWINGS

Figure 3:
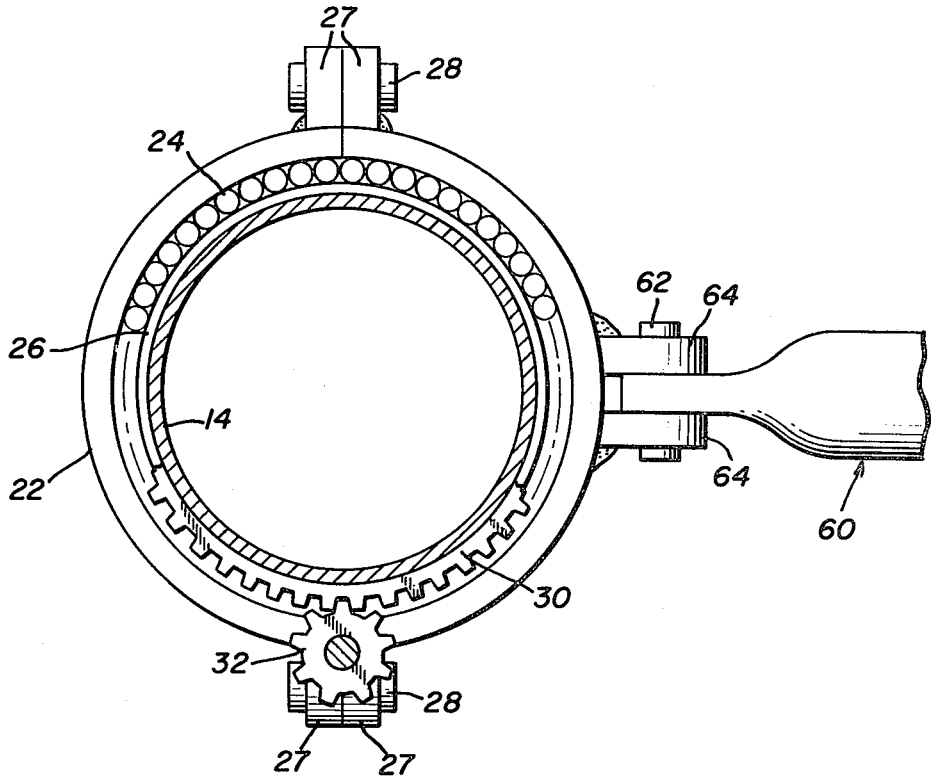
FIG. 3 is a plan view taken along the line 3—3 of FIG. 1.

To the extent it is reasonable and practical the same or similar elements which appear in the various views of the drawings will be identified by the same numbers.

With reference to FIG. 1, the spheroidal shell 10, adapted to store water or some other liquid, is mounted on a pedestal 12 extending upwardly from a supporting base not shown. The spheroidal shell 10 is provided with a fixed access column 14 which has a covered manhole 16 near the bottom. Shell 10 has a covered manhole 16, which provides access to tube 14, and a covered hatch 18 at the top.

A bearing mounted rotatable collar 20 is detachably mounted on the bottom of column 14 and a bearing mounted rotatable collar 22 is detachably mounted on the top of column 14. Each of the collars 20 and 22 is adapted to rotate or pivot about a vertical axis which coincides with the axis of column 14. Movement of the collars 20 and 22 is facilitated by ball bearings 24 mounted in a bearing race 26.

As shown in FIGS. 1 and 3, the collars 20 and 22, as well as the bearing races 26 associated therewith and the ball bearings contained therein, are constructed in integral half sections which can be joined together by bolts 28 or other suitable fasteners which extend through flanges 27 on the collars. The collar half sections are sized to be inserted into, and be removed from, the spheroidal shell 10 through hatch 18.

The upper collar 22 is provided with a ring gear 30 with which spur gear 32 meshes. Platform 32 is fixedly mounted on the upper part of column 14 above ring gear 30. Motor 34, mounted on platform 32, is operatively connected to gear box 35 from which a drive shaft extends on which spur gear 32 is driveably mounted.

A hydraulically extendable and retractable compression bearing first leg 40 is pivotally joined at its lower end by horizontal pin 42 to flanges 44 mounted on collar 20. The upper end of leg 40 is pivotally joined by horizontal pin 46 to flanges 48 mounted on the back of work platform 50 (FIGS. 1 and 2).

A hydraulically extendable and retractable tension second leg 60 is pivotally joined at its upper end by horizontal pin 62 to flanges 64 mounted on collar 22. The lower end of leg 60 is pivotally joined by horizontal pin 66 to flanges 68 mounted on the back of work platform 50.

Each of the hydraulically extendable and retractable legs 40 and 60 incorporates a double acting piston and connecting rod of conventional type so they will not be described further.

The work platform 50 includes a guide and horizontal speed control unit 52. In addition, work platform 50 has a spraygun 54 mounted thereon for applying an insulating foam, such as polyurethane foam, to the inside of spheroidal shell 10. Spraygun 54 is desirably mounted to move in a vertical reciprocating path as it sprays out a liquid foamable composition as the work platform moves in a horizontal path. Light 56 is mounted on the top of the work platform to illuminate the area being insulated. In addition, one or more cables 58 is run from leg 60 to the upper part of work platform 50 to permit adjustment of the work platform so as to have it substantially horizontal as it is raised or lowered by legs 40 and 60.

All of the described components except for column 14 are made so as to be inserted through hatch 18 for assembly inside of spheroidal shell 10. Once the shell has been insulated by the described apparatus it is disassembled and removed through the hatch 18.

The described apparatus is used to apply a layer of insulating foam on the interior surface of the double curved spheroidal shell 10 by first positioning the work platform 50 at a suitable location. The work platform can be positioned initially at the equator or as far up or down as it can be positioned in the shell. Then motor 34 is activated so that spur gear 32 will drive ring gear 30, thus causing collar 22 to rotate slowly. The rotation of collar 22 causes leg 60 to swing radially and its movement forces work platform 50, leg 40 and lower collar 20 to move radially at the same angular speed. As the platform 50 moves in a horizontal circular path spraygun 54 applies a layer of foamable liquid onto the interior surface of shell 10 as a band having any suitable vertical height but generally of about 3 to 5 feet. After a circular band of insulating foam is deposited as described, the spraygun is turned off while work platform 50 is adjusted vertically upwardly or downwardly by means of legs 40 and 60. Generally the work platform 50 will be adjusted vertically so as to deposit a subsequent band of insulation adjacent to a band previously deposited on the shell 10. Band after band of insulation is applied as described until the shell interior is covered with insulating foam except for circular areas at the top and bottom of the shell interior axially surrounding the ends of column 14. Unless two or more layers of insulation are to be applied on the shell interior by use of the described apparatus, the apparatus is disassembled and removed through hatch 18. Then the circular areas at the top and bottom of the shell are insulated by manual application of the foamable liquid insulating material.

It is obvious that the described apparatus can be used to apply various paints or coatings to the shell instead of insulating foam. In addition, it can be used to apply various structural elements to the shell wall for any intended purpose.

Figure 5:
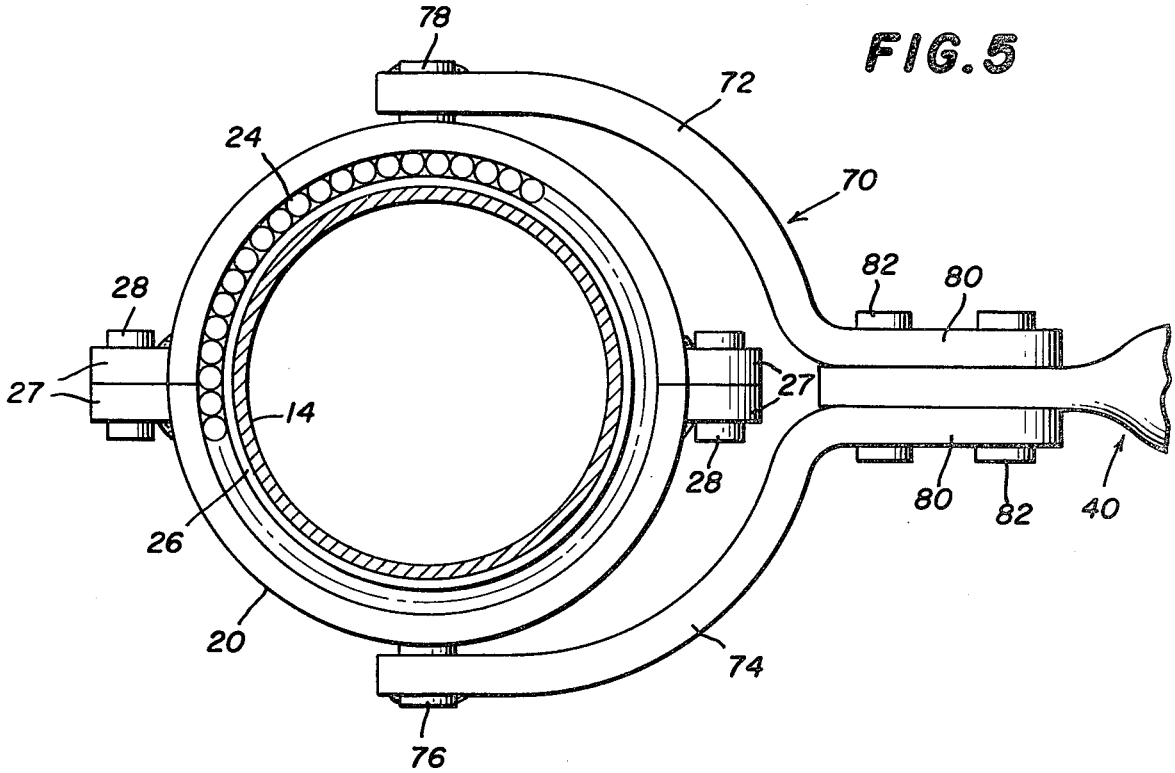
FIG. 5 is a plan view of the structure shown in FIG. 4.

FIGS. 4 and 5 illustrate an alternative structure which can be used to connect the ends of legs 40 and 60 to collars 20 and 22 respectively, and to the work platform 50. As shown in FIG. 5, yoke 70 is formed of identical elements 72 and 74 which are pivotally connected to trunnion pins 76 and 78 on collar 20. Each element 72 and 74 has a quarter circle curved section from the end of which a leg 80 projects radially. Each arm 80 is detachably connected to the end of leg 40 by bolts 82 or other suitable fasteners.

The foregoing detailed description has been given for clearness of understanding only, and no unnecessary limitations should be understood therefrom, as modifications will be obvious to those skilled in the art.

What is claimed is:

1. Apparatus for applying a coating to the inside surface of a double curved shell, comprising:

a work platform for coating equipment;

a first extendable and retractable leg in compression joined at its upper end to the platform and joined at its lower end through a horizontal axis pivot to first means rotatable about a vertical axis on a lower fixed base; and a second extendable and retractable leg in tension joined at its lower end to the platform and joined at its upper end through a horizontal axis pivot to means rotatable about a vertical axis on an upper fixed base spaced upwardly from the lower fixed base whereby the lower end of the first leg and the upper end of the second leg can rotate about the same vertical axis.

2. Apparatus according to claim 1 in which the first means rotatable about a vertical axis is a bearing mounted collar and the second means rotatable about a vertical axis is a bearing mounted collar.

3. Apparatus according to claim 1 in which the lower fixed base and the upper fixed base are each on a vertical column.

4. Apparatus according to claim 1, 2 or 3 in which the lower fixed base is inside and near the bottom of a spherical or spheroidal shell and the upper fixed base is inside and near the top of the said shell.

5. Apparatus according to claim 1 in which the first leg is hydraulically extendable.

6. Apparatus according to claim 5 in which the second leg is hydraulically extendable.

7. Apparatus according to claim 1 including means to maintain the platform approximately horizontal.

8. Apparatus according to claim 1 including power driven means to rotate the apparatus about the vertical axis.

9. Apparatus according to claim 1 in which the platform is vertically displaceable, by extending and retracting the first and second legs, for a distance less than the distance between the lower and upper fixed bases.

10. Apparatus according to claim 9 in which the platform is horizontally displaceable simultaneously with its vertical displacement.

* * * * *